US010421594B2

(12) United States Patent
Chevalley

(10) Patent No.: US 10,421,594 B2
(45) Date of Patent: Sep. 24, 2019

(54) PACKAGE COMPRISING PEEL-OFF LID AND DOSING SPOON

(71) Applicant: Soudronic AG, Bergdietikon (CH)

(72) Inventor: François Chevalley, Winterhur (CH)

(73) Assignee: SOUDRONIC AG, Bergdietikon (CH)

( * ) Notice: Subject to any disclaimer, the term of this patent is extended or adjusted under 35 U.S.C. 154(b) by 0 days.

(21) Appl. No.: 15/760,546

(22) PCT Filed: Aug. 22, 2016

(86) PCT No.: PCT/CH2016/000110
§ 371 (c)(1),
(2) Date: Mar. 15, 2018

(87) PCT Pub. No.: WO2017/045086
PCT Pub. Date: Mar. 23, 2017

(65) Prior Publication Data

US 2018/0257839 A1 Sep. 13, 2018

(30) Foreign Application Priority Data

Sep. 16, 2015 (CH) ..... 1344/15

(51) Int. Cl.
*B65D 77/24* (2006.01)
*B65D 17/50* (2006.01)
*B65D 17/28* (2006.01)

(52) U.S. Cl.
CPC ..... *B65D 77/245* (2013.01); *B65D 17/4011* (2018.01); *B65D 17/501* (2013.01);
(Continued)

(58) Field of Classification Search
CPC ..... B65D 17/502; B65D 17/4011; B65D 51/246; B65D 51/443; B65D 77/245
(Continued)

(56) References Cited

U.S. PATENT DOCUMENTS 1,768,771 A * 7/1930 La Tourrette ..... B65D 25/02 141/380
2,139,838 A * 12/1938 Mayer ..... A24F 23/04 131/243
(Continued)

FOREIGN PATENT DOCUMENTS

CN 2799445 Y 7/2006
CN 201105839 Y 8/2008
(Continued)

OTHER PUBLICATIONS

International Search Report for PCT Serial No. PCT/CH2016/000110 dated Oct. 21, 2016.

*Primary Examiner* — J. Gregory Pickett
*Assistant Examiner* — Brijesh V. Petel
(74) *Attorney, Agent, or Firm* — McCormick, Paulding & Huber LLP

(57) ABSTRACT

In a package having a dosing spoon for removing a filling material from the package, a container of the package is sealed with a peel-off lid that has a peel-off lid ring and a peel-off film. A leveling bar is provided that may be attached to the edge of the peel-off lid ring after the peel-off film has been removed. The leveling bar may be present in the package especially in combination with the dosing spoon, so that after the package is opened the leveling bar may be detached from the dosing spoon and may be attached to the edge of the peel-off lid ring.

8 Claims, 3 Drawing Sheets

(52) U.S. Cl.
CPC ..... *B65D 17/502* (2013.01); *B65D 2251/02* (2013.01); *B65D 2517/0016* (2013.01)

(58) Field of Classification Search
USPC ..... 220/212, 735, 266, 270, 359.2, 574.1, 220/780; 206/541, 223, 216; 30/324, 30/298.4; 215/228, 390
See application file for complete search history.

(56) References Cited

U.S. PATENT DOCUMENTS 5,491,897 A * 2/1996 Michelena ..... A47G 21/04 30/324
5,705,212 A * 1/1998 Atkinson ..... B65D 51/247 206/542
5,775,531 A * 7/1998 Lowry ..... B65D 17/502 220/212.5
5,992,667 A * 11/1999 Huang ..... A47G 21/02 206/541
7,464,475 B2 * 12/2008 Tsao ..... B65D 77/245 215/391
8,651,311 B1 * 2/2014 Drummond ..... B65D 51/247 220/212
2014/0001179 A1 * 1/2014 Prero ..... B65D 77/245 220/23.87
2014/0299567 A1 * 10/2014 Vogel ..... B65D 23/12 215/44
2015/0298883 A1 * 10/2015 Van Puijenbroek ..... B65D 77/245 426/106

FOREIGN PATENT DOCUMENTS

EP 0648681 A1 * 4/1995 ..... B65D 77/245
GB 2381785 A 5/2003
JP H1149172 A 2/1999
KR 200345436 Y1 3/2004
WO WO-2007131806 A1 * 11/2007 ..... B65D 77/245
WO 2008041808 A1 4/2008
WO 2013106943 A1 7/2013
WO 2014012690 A1 1/2014

* cited by examiner

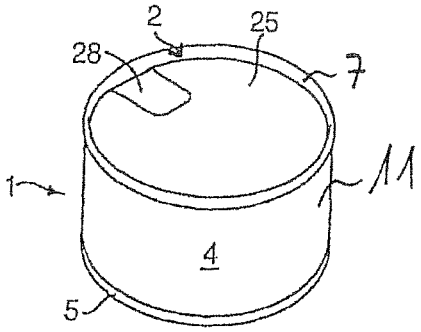
FIG. 1
Fig. 2
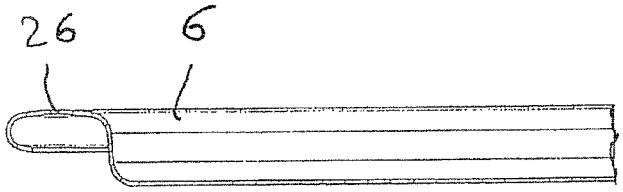
Fig. 3
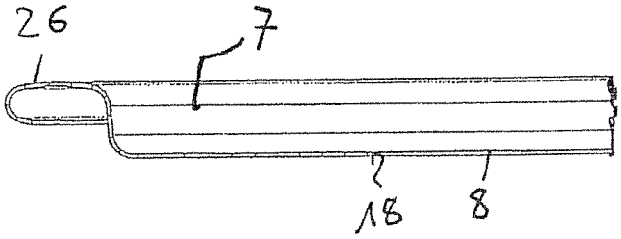
Fig. 4
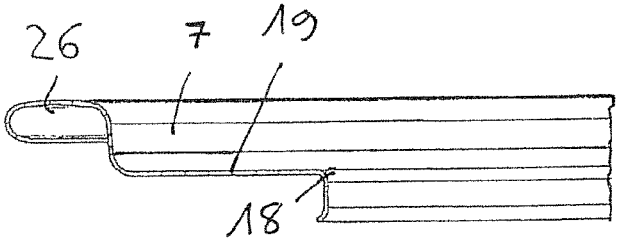
Fig. 5
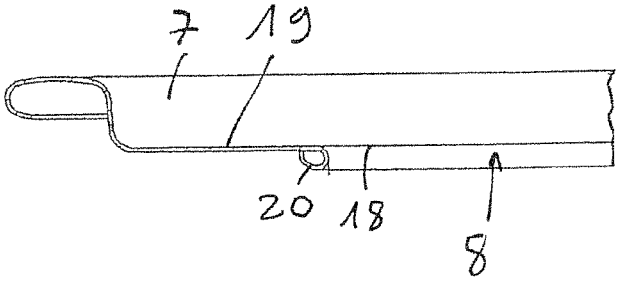

PACKAGE COMPRISING PEEL-OFF LID AND DOSING SPOON

CROSS REFERENCES TO RELATED APPLICATIONS

This application claims the priority of Swiss patent application No. 1344/15, filed Sep. 16, 2015, the disclosure of which is incorporated herein by reference in its entirety. The application is also a nationalization of PCT Application Number PCT/CH2016/000110 filed Aug. 22, 2016 which is incorporated herein by reference in its entirety.

FIELD OF THE INVENTION

The invention relates to a package comprising a container with a peel-off lid and dosing spoon. The invention furthermore relates to a combination of a dosing spoon and a leveling bar for such a package.

BACKGROUND OF THE INVENTION

Packages having a container in the form of a can with a "peel-off" lid having round or non-round removal openings beneath the peel-off lid are known. Usually, such packages or cans with a peel-off lid having a large diameter (typically 99 mm or more) are used for dry products, such as e.g. baby milk powder. A plastic spoon that is used to scoop the powder is added to most containers after the milk powder has filled into the container. Thus, once the package or can has been opened by peeling off the peel-off film of the peel-off lid, a spoon is available to the user and may be used for metering or dosing, respectively, the amount of filling material removed from the container. An additional lid, made of plastic, which is placed over the peel-off lid, is used in a known manner for reclosing the container until the next use.

One problem that occurs when scooping the powder is controlling or dosing, respectively, of the amount removed from the container. There are two main reasons for removing and dosing the quantity of powder as precisely as possible. The primary reason relates to health. The infant is to be given a precise quantity of milk powder. Not too much, and not too little. A second reason, which is more incidental than the first reason, is the price of cans of milk powder. It is especially in developing countries very high. Therefore the consumer has a reason for removing only the precise amount of milk powder. The can manufacturers try to provide a solution that makes it possible to meter or dose precisely. There are solutions that attempt to solve the dosing solely by the design of the dosing spoon and to create milk powder spoons with integrated leveling bars. However, industrial implementation of these solutions has not yet begun, since the manufacturing costs for the spoon are too high.

One solution the metal packaging industry propagates today is to integrate the leveling function for the spoon into the lid. Consequently, lids today are produced such that it is possible to scrape the spoon and thus level off its contents. This ensures that the amount of powder in the spoon is always the same. Such peel-off lids made of tin plate have an opening that is in the shape of a "D," instead of being round. That is, the opening of the lid remains largely round, but is closed off by a straight edge. The length of this edge may vary.

The great advantage of the so-called D-shape peel-off lids is that the leveling bar is integrated in the lid. The user can use the leveling bar immediately, as soon as the peel-off film has been removed from the container and the spoon has been taken out of the milk powder. The leveling function is self-explanatory.

However, the disadvantage of the D-shape peel-off lid is found in its production process. The non-round form of the opening requires non-round tools for punching out the opening and then for shaping the edge. In addition, the lid must be laboriously re-oriented after each work step so that it is not damaged in the next operation.

Another disadvantage is the fact that, as a rule, a filling company that fills the container with the powder product does not sell only lids having a D-shape opening. Some of the lids are produced with a conventional round opening. This means that two sets of tools must be purchased and maintained for production. In addition, there are time-consuming tool changes when the shape of the opening has to be changed.

It is known from WO 2008/041808 to provide a separate part as a leveling bar, wherein this part may be positioned at different heights on the interior can surface. This solution appears very complex and also complicated to handle.

SUMMARY

The object of the invention is to allow the lid manufacturer to manufacture all lids with the identical opening. Thus all lids are manufactured with a round opening. Only subsequently, that is, after the can has been sealed, is it provided or not provided with the leveling function. This provides the manufacturer the greatest possible flexibility in manufacture and logistics. The leveling function should be attainable in the simplest and most cost-effective manner possible.

This object is attained in a package comprising a container with a peel-off lid and incorporating a dosing spoon and a leveling bar.

Using the leveling bar that can be attached to the edge of the removal opening, dosing is made possible in a simple manner and the handling of this leveling bar is very simple. There is no interference with the manufacture of the lid, since all lids, round or non-round, are provided with the leveling function using an additional part only subsequently. A leveling bar is thus supplied as a separate part, preferably a plastic part, and can be attached to the removal opening of the can after the peel-off film has been removed therefrom, and prior to the can's use after its opening.

As is known, milk powder cans have an additional plastic lid (snap-on lid) that is provided above the peel-off lid. There are two reasons for this lid. First, the can remains open for several days because of course it is not all used up in one feeding. Consequently, the can must be re-closed after the contents are used for the first time so that the milk powder does not become moist. The second reason is that a peel-off lid alone may be considered too delicate, since the peel-off film could be damaged during transport or storage. In certain sales markets, the snap-on lid is attached in a manner such that it also satisfies so-called "tamper-proofing" requirements.

In one embodiment of the package having a snap-on lid over the peel-off lid, the leveling bar may be provided between the peel-off lid and the plastic lid until the levelling bar is used.

However, each can usually contains a plastic spoon, as a dosing or metering spoon, respectively, that is added while the can is being filled with milk powder. In one preferred embodiment, it is thus possible to design the spoon such that it contains the leveling bar. Thus the spoon and the leveling bar may be manufactured in the same work step. The increase in costs is limited to the greater complexity of the tool and use of more materials. Once the can has been opened and the spoon has been taken out, the leveling bar is removed or broken off, respectively, and placed into the opening. This can occur at any location on the round opening. The instructions for removing or breaking off the bar and for attaching it in the removal opening as a leveling bar may be printed on the can.

The leveling bar may be made of plastic or metal. It may be molded in the shape of a narrow bar or even in a D shape. The bar is preferably provided with a slit or groove at both ends. Its function is to be able to push the leveling bar over the rolled-in part of the edge of the removal opening and attach the leveling bar to this rolled-in part of the edge, so that the edge of the removal opening fits securely into the groove of the levelling bar. The rolled-in part is also called a C-curl. At the ends of the leveling bar, the slit or groove is designed such that the leveling bar is thereby attached at the edge and cannot detach from the edge of the removal opening by itself or when the spoon is scraped along the leveling bar. A molding, e.g. a bulge, may be provided in the slit or groove, which molding prevents the leveling bar from being pulled out without the use of force.

If the leveling bar is configured in the shape of a D, the leveling bar may be provided with a slit in the entire curved area of the D or only at 2 or more locations.

After the peel-off film of the peel-off lid has been removed and the spoon has been taken out, the bar may also be used for suspending the spoon after use. Otherwise the spoon rests on the milk powder. The spoon may be molded with a small hook so that it can be suspended from the bar after use.

Thus it may be possible to attach the leveling bar, at its end areas that oppose one another longitudinally, in a force-fit or a form-fit on the edge of the removal opening. To this end, the person skilled in the art may select any configuration of the ends of the leveling bar and the edge of the removal opening. In particular, the leveling bar has at each of its end areas a groove that is embodied for receiving the edge of the opening.

The end areas of the leveling bar may be embodied running obliquely to the longitudinal direction of the leveling bar in order to provide a good match with the round shape of the removal opening.

The leveling bar is preferably made of plastic. It is furthermore preferred that the leveling bar, as package part, is embodied such that, prior to use, it is connected to the dosing spoon. The leveling bar may be connected to the dosing spoon in a force-fit and/or a form-fit, and the dosing spoon may especially have a molding that is embodied for connecting to the groove of the one end area of the leveling bar.

The dosing spoon and the leveling bar may also be embodied integrally, wherein the connection between leveling bar and dosing spoon includes a weakening zone that permits the leveling bar to be separated from the dosing spoon at the weakening zone.

A further object of the invention is to create an improved dosing spoon for a package in accordance with the invention.

This object is attained in that the dosing spoon is connected to a leveling bar to form a combination of both parts, wherein the leveling bar is detachable from the dosing spoon, especially to be able to be detached without a tool, and then is usable as a leveling bar on the package.

The leveling bar may be connected to the dosing spoon in a force-fit manner or a form-fit manner, especially in that the dosing spoon has a molding that is designed for connecting to the groove of the one end area of the leveling bar. Thus the leveling bar may simply be detached manually from the spoon and then placed in the removal opening and attached to its edge.

On the other hand, the dosing spoon and the leveling bar may also be embodied integrally, wherein the connection between leveling bar and dosing spoon includes a weakening zone that permits the leveling bar to be separated from the dosing spoon at the weakening zone. In this way, as well, the leveling bar may be simply manually separated from the spoon and then placed in the removal opening and attached to its edge.

BRIEF DESCRIPTION OF THE DRAWINGS

Other embodiments, advantages, and applications of the invention result from the dependent claims and from the following description, using the figures.

FIG. 1 is a drawing of a package or container having a peel-off lid;

FIGS. 2 through 5 depict steps in the formation of a peel-off lid ring for a peel-off lid;

DESCRIPTION OF THE PREFERRED EMBODIMENTS

Figure 6:
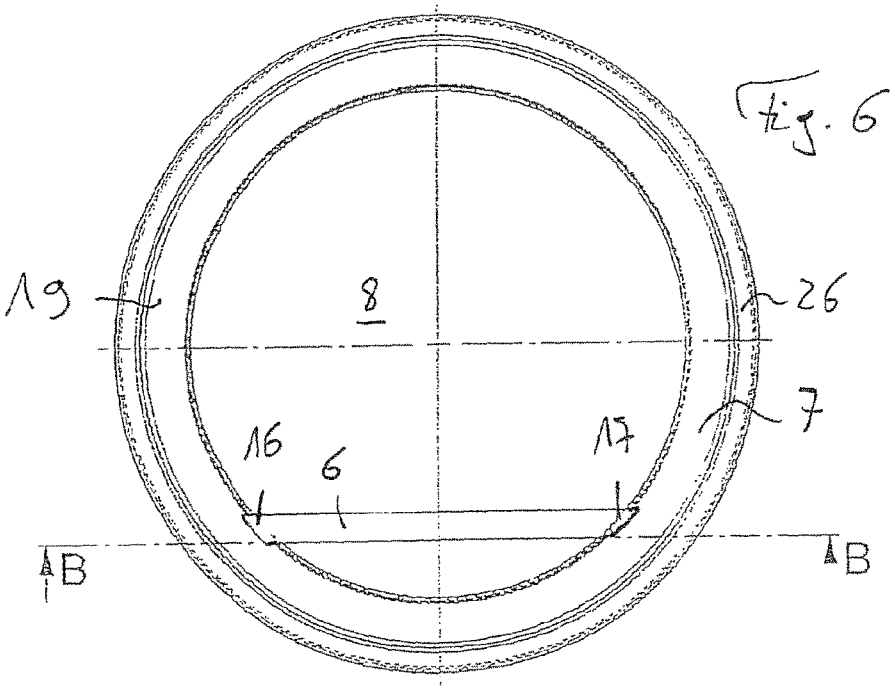
FIG. 6 is a top view onto a peel-off lid ring with leveling bar.

Exemplary embodiments of the invention are described in the following using the figures. FIG. 1 depicts a package 1 that comprises a container 11 having a peel-off lid 2. The container is especially a can made of metal or cardboard or plastic or a composite material, especially a composite material comprising metal.

The container 11 has a can body 4, a can bottom 5, and the peel-off lid 2. In this case it is a three-part can with body, bottom, and lid. The invention may also be used in two-part cans, in which body and bottom are integral. The container is especially provided for receiving a dry powder product.

The bottom and the peel-off lid are each connected to the body by means of a folded joint, for instance, which is known to the person skilled in the art and does not require further explanation herein.

The peel-off lid 2, in a known manner, comprises a peel-off lid ring 7 and the peel-off film 25 attached thereto, which may have a pulling tab 28. To open the container 1, the peel-off film 25 is pulled off from the peel-off lid ring so that the contents of the container 1 are accessible in that the removal opening 8 enclosed by the edge of the peel-off lid ring is uncovered.

The package furthermore comprises a dosing spoon and a leveling bar. The dosing spoon permits a certain amount of the filling material to be removed from the container and the leveling bar permits the dosing spoon to be scraped so that after it has been scraped it is filled only up to the edge of the spoon, so that a dosed amount of the filling material is present within the spoon. In FIG. 1, the dosing spoon and the leveling bar, which are preferably joined to one another, are disposed below the yet unopened peel-off lid and are therefore not visible in the figure. In such an embodiment, the leveling bar is accessible after the peel-off lid has been opened. Then the leveling bar is attached in the removal opening, as shall be explained. If an additional snap-on lid (not shown in FIG. 1) were present over the peel-off lid 2, the leveling bar could also be arranged between the peel-off lid and the snap-on lid as a separate part of the package and would then be accessible after the snap-on lid was opened. In this embodiment, the leveling bar would also be used after the peel-off film had been removed and would then be attached over the opening.

FIGS. 2 through 5 depict steps, known to the person skilled in the art, in the formation of the peel-off lid ring, wherein only a portion of the ring is depicted in cross-sectional view. FIG. 2 depicts a blank 6 for the formation of the peel-off lid ring of the peel-off lid 2, wherein at its outer edge 26 the blank is already provided with the shape suitable for the folded joint connection with the container body. In FIG. 3, a center disk-shaped part has already been punched out of the blank 6 in order to form the peel-off lid ring 7 that with its inner edge 18 delimits the removal opening 8 of the lid. Adjacent to the edge 18 of the removal opening 8, the sealing surface 19 extends radially outward, onto which sealing surface the peel-off film 25 is sealed in a known fashion. FIGS. 4 and 5 depict a preferred shaping of the edge 18 that delimits the removal opening 8. The edge 18 in FIG. 4 initially curves downward (or inward, into the container, relative to the later position of the peel-off lid on the container) and then, as shown in FIG. 5, radially outward and again upward. A rolled edge or roll-in 20 or so-called C-curl is thus formed. A different shaping of the edge 18 of the removal opening is also possible, wherein the issue is delimiting the removal opening such that the user cannot be hurt by the edge of the package.

In accordance with the invention, after the peel-off film 25 of the package 1 has been removed by the user, the leveling bar is attached to the edge 18 of the removal opening 8 on a peel-off lid ring embodied in this manner or in a similar manner. FIG. 6 provides a top view onto a peel-off lid ring 7 with the removal opening 8 and thus also provides a view of into the container interior and onto the filling material when the peel-off lid ring is attached to a container. In this example, the leveling bar 6 is a straight bar. A D shape is also possible, as mentioned in the foregoing, wherein the curvature of the D shape would fit into the curvature of the removal opening 8.

The mutually opposing end areas 16 and 17 of the leveling bar are for attaching the latter to the peel-off lid and extending over the removal opening. It may be seen that the length of the leveling bar determines how far the leveling bar is positioned from the center of the opening when the leveling bar is attached to the edge 18 of the removal opening. This distance is selected such that simple access to the filling material is possible with the dosing spoon 3.

Attaching the leveling bar 6 means that the latter is held on the edge 18 securely enough that it is possible to scrape the dosing spoon 3 on the leveling bar without the bar 6 thereby detaching from the edge 18. There may be a permanent, "non-detachable" attachment, so that the leveling bar may only be detached from the edge 18 by destroying the bar, or there may be a detachable attachment that makes it possible, with sufficient force, to detach the bar 6 from the edge 18 without destroying the bar 6. The various options for the person skilled in the art result from the particular situation.

In the example shown in the figures, the end areas 16 and 17 of the leveling bar 6 are provided with a groove 21 that is embodied to receive the edge 18 of the peel-off lid ring so that the leveling bar is held on the edge 18 in a force-fit, for example, so that the edge 18 engages in the groove 21 and is held there with a gripping force that results from the overlap of the edge 18 by the parts of the leveling bar limiting the groove 21. However, there may also be moldings in the groove that result in a form-fit between leveling bar and edge 18, especially the roll-in 20. Thus the leveling bar is more difficult to detach from the edge 18 by such a form-fit than with a force-fit only connection. However, the leveling bar 6 could also be provided in its end areas 16 and 17 with adhesive surfaces with which it could be fixed to the top of the edge 18 and thus also to the sealing surface 19 by such an adhesive. In the context of the invention, this shall also be understood to fall under the term attachment.

Figure 7:
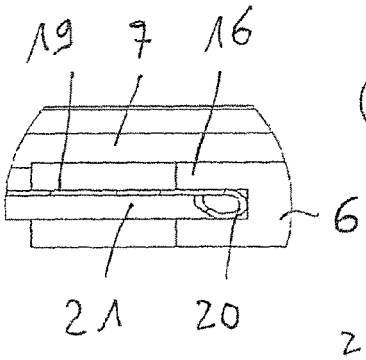
FIG. 7 is a partial view of the section along the section line B-B in FIG. 6.

FIG. 7 depicts the explained solution with a groove 21 in an enlarged depiction in which only the end area 16 of the bar 6 is depicted in a view onto the sectional line B-B from FIG. 6. It can be seen how the roll-in 20 is positioned within the groove 21.

Figure 8:
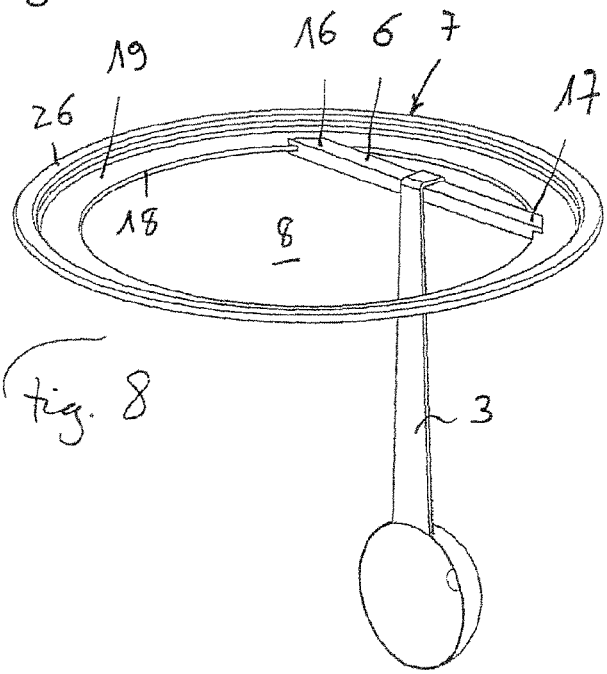
FIG. 8 is a drawing of a peel-off lid ring with added leveling bar and with a dosing spoon; and, FIGS. 9 through 11 are drawings of a dosing spoon and combination made of a dosing spoon and leveling bar.

FIG. 8 is a drawing showing only the peel-off lid ring 7, without the container 11, and with the peel-off film already removed, so that the leveling bar 6 could have been attached to the edge 18 as shown. The dosing spoon 3 here is depicted in a position in which it is suspended from the bar. Both spoon 3 and bar 6 are preferably made of plastic in this case. During use, the spoon is heaped with the filling material from the container 11 or package 1, respectively, and then the spoon is scraped on the bar 6 so that the filling material remaining in the spoon 3 only reaches to the upper edge of the spoon and the previously excess, "heaping" filling material falls back into the container.

Figure 9:
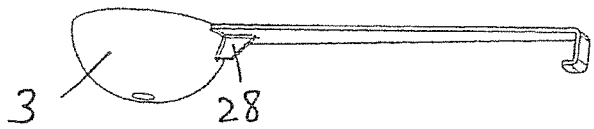
Figure 10:
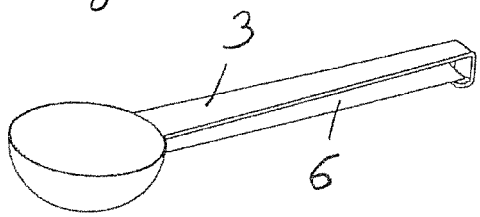
Figure 11:
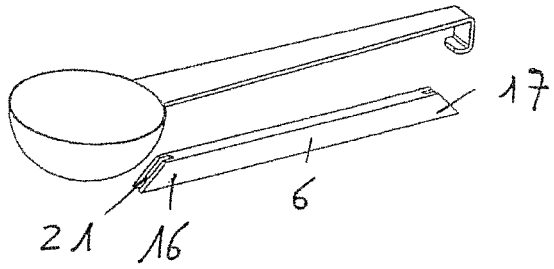

FIGS. 9 through 11 provide views of a dosing spoon 3 and a leveling bar that is connected thereto but is detachable from the spoon 3. In this example, a molding 28 is provided on the spoon 3 that is shaped such that it fits into the groove 21 of the leveling bar 6 such that the leveling bar 6 is retained on the spoon 3 until the user removes or detaches the bar 6 from the spoon 3 in order to attach the bar 6 over the removal opening of the container. This embodiment is in particular depicted in FIGS. 9 and 11. FIG. 10 depicts a simpler design of the leveling bar, for example for adhesive attachment to the peel-off lid ring. In this case, the leveling bar may be embodied, for instance, integrally with the spoon 3, wherein a weakening zone is provided that results in a break line between spoon 3 and bar 6. Thus the bar 6 may also be separated from the spoon 3 and then attached to the edge 18 and, as the case may be, to the adjacent sealing surface 19. As well in the embodiment in accordance with FIGS. 9 and 11 the spoon and the bar could be provided such that there is an integral connection that has a weakening zone. This then replaces the molding 28 on the spoon.

Thus, in a package having a dosing spoon for removing a filling material from the package, a container of the package is sealed with a peel-off lid that has a peel-off lid ring and a peel-off film. A leveling bar is provided that, after the peel-off film has been removed, may be attached on the edge of the peel-off lid ring. The leveling bar may in particular be present in the package in combination with the dosing spoon. In this case, the leveling bar may be detached from the dosing spoon after the package has been opened and may be attached to the edge of the peel-off lid ring.

While preferred embodiments of the invention are described in this application, it should clearly be noted that the invention is not limited to them and may be embodied in another manner within the scope of the following claims.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A package, comprising a container for receiving a filling material, a peel-off lid connected to the container and having a peel-off lid ring made of metal and a peel-off film, which peel-off lid ring forms the edge of the removal opening of the package, and further comprising a dosing spoon and a leveling bar, wherein the leveling bar is provided as a part of the package being separate from the peel-off lid and spoon, and has opposed end areas with grooves shaped to receive the edge of the removal opening formed by the peel-off lid ring with a force-fit or form-fit attachment, and the dosing spoon has a molding that is shaped for connecting to the groove at one end area of the leveling bar.

2. The package according to claim 1, wherein the end areas of the leveling bar are provided as running obliquely to the longitudinal direction of the leveling bar.

3. The package according to claim 1, wherein the leveling bar is made of plastic material.

4. The package according to claim 1, wherein the edge of the removal opening has a rolled-in shape on the underside of the lid, and in that the leveling bar is provided to engage on the rolled-in shape when the leveling bar is attached to the edge of the removal opening.

5. A combination of a dosing spoon and a leveling bar for use with a container that receives a fillable material and has a lid with a removal opening, wherein the leveling bar has opposed end areas with grooves shaped to receive an edge of the removal opening in the lid with a force-fit or form-fit attachment, and the dosing spoon has a molding that is shaped for connecting to the groove at one end area of the leveling bar.

6. The combination according to claim 5, wherein the leveling bar is connected to the dosing spoon in a force-fit or in a form-fit connection.

7. A package comprising: a container for receiving a filling material, a peel-off lid connected to the container and having a peel-off lid ring made of metal and a peel-off film, which peel-off lid ring forms the edge of the removal opening of the package, and further comprising: a dosing spoon and a leveling bar embodied as a package part, the dosing spoon and the leveling bar being connected to one another, the connection being formed by a groove at one end area of the leveling bar and a molding on the spoon, the molding being shaped for connection with the groove of the leveling bar.

8. The package according to claim 7, wherein the leveling bar is connected in a force-fit or a form-fit manner to the dosing spoon.

* * * * *